US006640525B1

(12) United States Patent
Coats

(10) Patent No.: US 6,640,525 B1
(45) Date of Patent: Nov. 4, 2003

(54) SADDLE PAD

(76) Inventor: Larry Coats, 6910 Treece Rd., San Angelo, TX (US) 76905

( * ) Notice: Subject to any disclaimer, the term of this patent is extended or adjusted under 35 U.S.C. 154(b) by 0 days.

(21) Appl. No.: 10/242,223

(22) Filed: Sep. 12, 2002

(51) Int. Cl.[7] ..... B68C 1/12
(52) U.S. Cl. ..... 54/66; 54/41.1; 54/44.5
(58) Field of Search ..... 54/66, 65, 44.5, 54/46.1, 46.2, 41.1, 42.1, 44.7, 79.3

(56) References Cited

U.S. PATENT DOCUMENTS

| | | | | | |
|---|---|---|---|---|---|
| 721,653 | A | * | 3/1903 | Amos | 54/66 |
| 3,971,194 | A | | 7/1976 | Morgan | |
| 4,136,506 | A | | 1/1979 | Miller | |
| 4,324,090 | A | * | 4/1982 | Nix | 54/44.5 |
| 4,683,709 | A | | 8/1987 | Vasko | |
| 4,827,701 | A | | 5/1989 | Gonzales | |
| 4,974,397 | A | | 12/1990 | Ricken | |
| 5,018,341 | A | | 5/1991 | Evertson | |
| 5,027,589 | A | | 7/1991 | Gleb | |
| 5,058,367 | A | | 10/1991 | Evertson | |
| 5,119,618 | A | | 6/1992 | Streck | |
| 5,175,986 | A | | 1/1993 | Farley | |
| 5,299,412 | A | * | 4/1994 | Cudney et al. | 54/66 |
| 5,353,577 | A | | 10/1994 | Thurston | |
| 5,363,631 | A | | 11/1994 | Garrison | |
| 5,575,139 | A | | 11/1996 | Green | |
| 5,782,070 | A | | 7/1998 | Knights | |
| 5,787,692 | A | | 8/1998 | Purdy | |
| 5,802,823 | A | | 9/1998 | Woods | |
| 6,067,781 | A | | 5/2000 | Ford | |
| 6,125,616 | A | | 10/2000 | Brown | |
| 6,370,850 | B1 | | 4/2002 | Zilka | |

* cited by examiner

*Primary Examiner*—Peter M. Poon
*Assistant Examiner*—Son T. Nguyen
(74) *Attorney, Agent, or Firm*—Cline H. White; Jackson Walker LLP

(57) ABSTRACT

A novel saddle pad will help disburse the pressure over a greater area on the animal's back, thus reducing pressure points and reducing discomfort for the animal. The saddle pad works by providing a bar cutout area that is thinner than the remainder of the saddle pad. Saddle skirts, while somewhat flexible, generally have some rigidity. The saddle is placed over the saddle pad with the tree resting over the thinner, bar cutout area, while the remainder of the saddle skirt rests over the thicker, standard area. The skirt flexes outwardly slightly, but as it resist further outward flexion, there is an equalization of the pressure exerted from the saddle and rider over the entire underside of the saddle rather mainly under the tree. In this manner, downward force is disbursed.

6 Claims, 5 Drawing Sheets

SADDLE PAD

BACKGROUND OF THE INVENTION

1. Field of the Invention

Applicants' invention relates to saddle pads and other such padding devices used to reduce a riding horse's discomfort as caused by saddles. More particularly, it relates to a saddle pad designed to equalize pressure applied by the saddle to the horse's back across the entire inner surface of the saddle.

2. Background Information

Saddle pads are ancient devices that continue to be used in modern times. It was found that saddles; of all types, if used directly on a horse's back, tended to cause galling, or sores, to develop on the horse's back as the result of pressure and rubbing exerted by the saddle on the horse's back. This was the result of virtually any rigid type saddle. But, because the characteristics of a rigid saddle were, and are, desirable, rigid saddles remain the norm.

To combat galling, riders place protective padding over the horse's back between the animal and the saddle. Saddle pads, or as they are sometimes referred to as saddle blankets, began as course woven blankets, generally made from cotton or wool. Saddle pads of this type were the standard until relatively recently. With the advent of many new manmade and composite materials to choose from, saddle pads are now being made in a wide variety of such materials. The new materials have allowed saddle pad manufacturers to improve the shock absorbency and comfort of the newer saddle pads.

However, despite these improvements, problems still remain. Western saddles are still made in a manner that creates pressure points. This is because the "skeleton" of the saddle is a hard tree made from wood, plastic or fiberglass. The tree is then covered by the various layers of leather and an inner covering of either natural or manmade fleece. However, because the weight of the rider presses down on the top of the saddle, the pressure is transferred through the hard tree and directed toward the horse's back. Although the leather covering, or skirts, are relatively thick and stiff, they are still flexible which allows them to "lift" or flex as the rider's weight presses down. Thus, although the saddle skirt may cover a wide area it does little to reduce the pressure exerted by the tree, the majority of pressure is exerted over a relatively small area beneath the tree.

In order to combat this problem and in an attempt to combat the pressure exerted by the tree, the standard practice has been to increase the thickness of the padding. This can be done either by using multiple saddle pads or increasing the thickness of a single saddle pad. Additionally, because the problem of the pressure points exerted by the tree has been recognized, inventions disclosed in the prior art follow the same line of reasoning by increasing the thickness of the saddle pad in the area beneath the tree, adding inserts beneath the tree, or increasing the shock absorption or density of the saddle pad beneath the tree.

This line of reasoning can be seen in patents such as: Zilka, Patent Number 6,370,850, which uses a material with greater resistance to compression and an increased ability to absorb concussive and compressive forces in the remainder of the pad; Woods, U.S. Patent No. 5,802,823, which adds multiple shock absorbing panels to the saddle pad; Knight, et al, U.S. Pat. No. 5,782,070, which incorporates an inflatable bladder to increase the padding; Garrison, U.S. Pat. No. 5,363,631, which incorporates plastic-encased gel molds; Cudney, et al, U.S. Pat. No. 5,299,412, which adds an impact absorbing foam core to the saddle pad; Evertson, U.S. Pat. No. 5,058,367, which provides increased padding beneath the saddle; Gleb, et al, U.S. Pat. No. 5,027,589, which incorporates two envelopes on either side of the saddle pad designed to receive foam inserts; Ricken, U.S. Pat. No. 4,974,397, which incorporates multiple layers to attempt to disburse the pressure; Gonzales, U.S. Pat. No. 4,827,701, which discloses thickened pads located at pressure points; and Vasko, et al, U.S. Pat. No. 4,683,709, which incorporates a pair of pockets which can receive shock absorbing inserts.

As exemplified above, the general approach to combating the pressure points has been to increase the thickness of the saddle pad beneath the pressure points. It would therefore be advantageous to provide an alternative, effective method for reducing pressure points exerted by the saddle and rider without increasing the thickness or density of the saddle pad beneath the pressure points.

Thus, there is a need for a device for dispersing the pressure points over a greater area under the saddle.

SUMMARY OF THE INVENTION

The present invention provides for a novel saddle pad that will help disburse the pressure over a greater area on the animal's back, thus reducing pressure points and reducing discomfort for the animal. The current invention does this by going against conventional ideas and the prior art for combating the pressure point problem. Instead of adding material under the tree, the present invention works by reducing the amount of material under the tree. The present invention provides for a bar cutout area that is thinner than the remainder of the saddle pad.

The saddle pad of the present invention works to reduce pressure points because the skirts, while somewhat flexible, have some rigidity. Thus, when the saddle is placed over the saddle pad of the current invention, the saddle is placed on the saddle pad such that the tree rests over the bar cutout area while the remainder of the saddle skirts rest over the pad standard area. Because the pad standard area is thicker than the bar cutout area, the skirts are allowed to flex outwardly slightly, but as they resist further outward flexion, there is an equalization of the pressure exerted from the saddle and rider. In this manner, when the portion of the saddle containing the wooden tree settles into the bar cutout area, downward force is disbursed. As downward force is disbursed, pressure points are reduced or eliminated providing better comfort for the animal and reducing the possibility of galling.

Because saddles come in many different shapes and sizes, it is anticipated that the saddle pad of the present invention will be manufactured in varying embodiments wherein the bar cutout area can be manipulated to best fit the saddle that the saddle pad is to be used with. Therefore, a saddle pad incorporating the present invention could be designed for a specific saddle, or a more general saddle pad incorporating the present invention could be designed for a general type of saddle such as a standard sized western saddle.

It should also be apparent that there are many ways to design an embodiment of a saddle pad incorporating the present invention. For example, the bar cutout area of the saddle pad may be "cut out" from the remainder of the saddle pad, or the pad standard area may be built up in comparison to the bar cutout area. In all embodiments of the present invention, it is anticipated that all saddle pad material and designs could be applied. For example, many saddle pads employ multiple layers of materials, layers designed to lay in contact with the animal, shock absorption layers, moisture wicking layers, shell layers, and protective layers that are designed to reduce wear from straps and buckles of the saddle that are tightened against them. Use of some, all, or other layers would not inhibited by the current invention. Even specialty layers or inserts as shown in the prior art could be incorporated in the present invention so long as the cutout portion of the saddle pad, or bar cutout area, is incorporated.

Similarly to the varying layers and materials, choice of shapes, sizes, and other designs would not inhibited by the present invention. So long as the bar cutout area is incorporated into the saddle pad, the present invention can be made in any embodiment to suit the user's needs.

DETAILED DESCRIPTION OF THE PREFERRED EMBODIMENT

Figure 1:
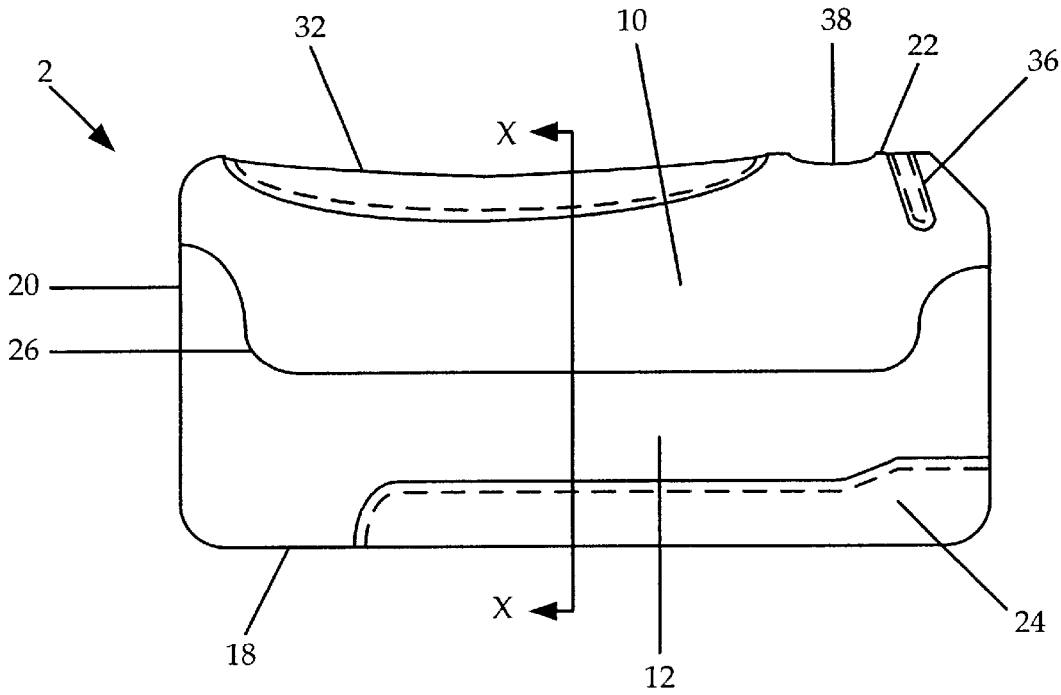
FIG. 1 is a side view of the present invention.

Referring to the figures, FIG. 1 is a side view of the present invention. It is illustrative of a modem style saddle pad (2). This figure illustrates a general shape of a saddle pad (2) that incorporates a bar cutout area (10). The pad standard area (12) is of a substantially uniform thickness while the bar cutout area (10) is of a lesser thickness. The pad standard area (12) extends from the cutout bottom shoulder (26) to the pad bottom edge (18). The pad standard area (12) is designed to fit under the skirt inner surface (64). The bar cutout area (10) is designed to fit beneath that portion of the skirt inner surface (64) within which the saddle tree first bar (50) and second bar (52) rest. It should be understood that FIG. 1 illustrates a pad first side,(34A) of the saddle pad (2) and that a pad second side (34B) of the saddle pad (2) is substantially identical to the pad first side (34A) shown, and both sides (34A and 34B) are substantially symmetrical about the pad (2) middle seam (32). The saddle pad (2) is designed to lay over an animal's, such as a horse, back with the pad (2) middle seam (32) laying along the animal's spine (not shown). The saddle pad (2) is sized to fit over a portion of the animal's (8) back.

FIG. 1 also illustrates that many features incorporated in modern saddle pads (2) can also be incorporated in a saddle pad (2) of the present invention. For example, an expansion slot (38) is designed to lay over a horse's withers and allow for better fit, additionally protective materials such as the wear leather (24) and the gullet wear leather (36) can help resist wear of the saddle pad (2).

The bar cutout area (10) is designed to generally mirror the shape of the saddle tree (4) and can extend from the pad front edge (16) to the pad rear edge (20). The bar cutout area (10) is sized so that the bar cutout area (10) is larger than that portion of the bars (50 and 52) that exert pressure on the animal (8). In order to fit a maximum number of saddles (6), some embodiments of the present invention may incorporate a bar cutout area (10) of a fairly generic shape such as is shown in FIG. 1. However, it is anticipated that saddle pads (2) could be designed for specific saddles (6) with bar cutout areas (10) sized and shaped to fit a specific saddle tree (4) or saddle (6).

In this embodiment, the bar cutout area (10) extends from the pad top edge (22) downwardly to the cutout bottom shoulder (26). The depth of the bar cutout area (10) is generally between 1/16 inch to ½ inch thinner as compared to the pad standard area (12). The depth of the bar cutout area (10), or second thickness (42), can be modified in order to accept that portion of the saddle (6) that holds the saddle tree (4). Likewise, the height of the pad standard area (12), or first thickness (40), can be modified to extend around the bar cutout area (10) so as to accept that portion of the saddle (6) that holds the saddle tree (4). If a saddle (6) has a skirt (68) made from a relatively more flexible material, then the bar cutout area (10) should be of a greater depth, or the second thickness (42) should be relatively less than the first thickness (40), to allow the saddle pad (2) to accept the portion of the skirt inner surface (64) that contains the saddle tree (4) while the pad standard area (12) presses against the remainder of the skirt inner surface (64).

Figure 2:
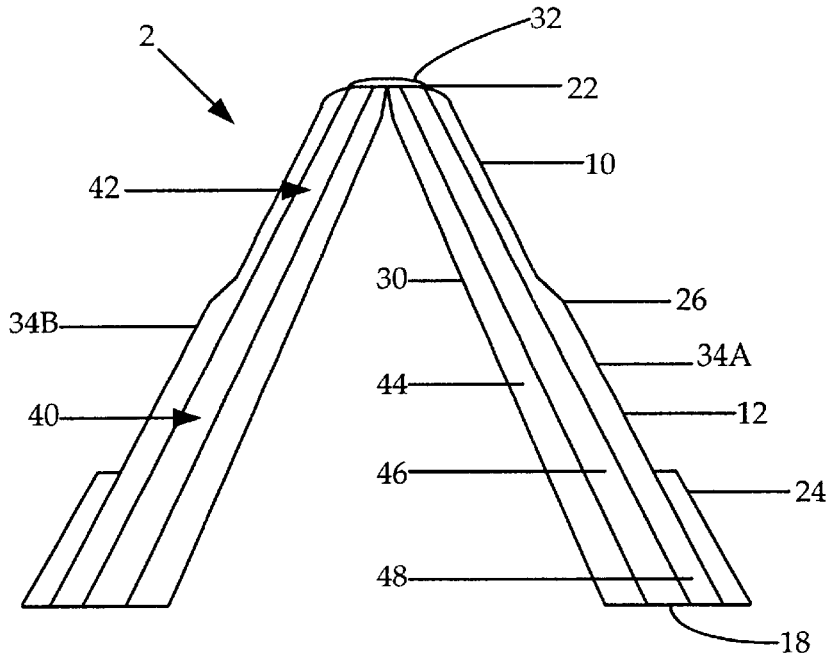
FIG. 2 is a front view of the present invention.

FIG. 2 is a cross-sectional, front view of the present invention taken along line X×X of FIG. 1. It shows the saddle pad (2) with both a pad first side (34A) and a pad second side (34B). Each of these sides of the saddle pad (2) is substantially identical to the other. The two pad sides (34A and 34B) are flexibly connected along a pad middle seam (32) at the pad top edge (22). This figure further illustrates the pad standard area (12):which has a first thickness (40), and the bar cutout area (10) which has a second thickness (42). The pad inner surface (30) lays against the back and sides of the horse (not shown) with the pad middle seam (32) laying along the spine of the animal (not shown) and the pad bottom edge (18) extending down the side of the animal (not shown). This figure more clearly shows the cutout bottom shoulder. (26) which is an interface between the first thickness (40) of the pad standard area (12) and the second thickness (42) of the bar cutout area (10). The pad sides (34A and 34B) may be made from one or a, plurality of materials. In the embodiment illustrated in FIG. 2, a first material (44) layer, a second material (46) layer, and a third material (48) layer are illustrated. Any of these layers may be built up or added to obtain the first thickness (40) of the pad standard area (12), or may be reduced or eliminated in order to obtain the second thickness (42) of the bar cutout area (10). Also illustrated in this figure is the wear leather (24).

Figure 3:
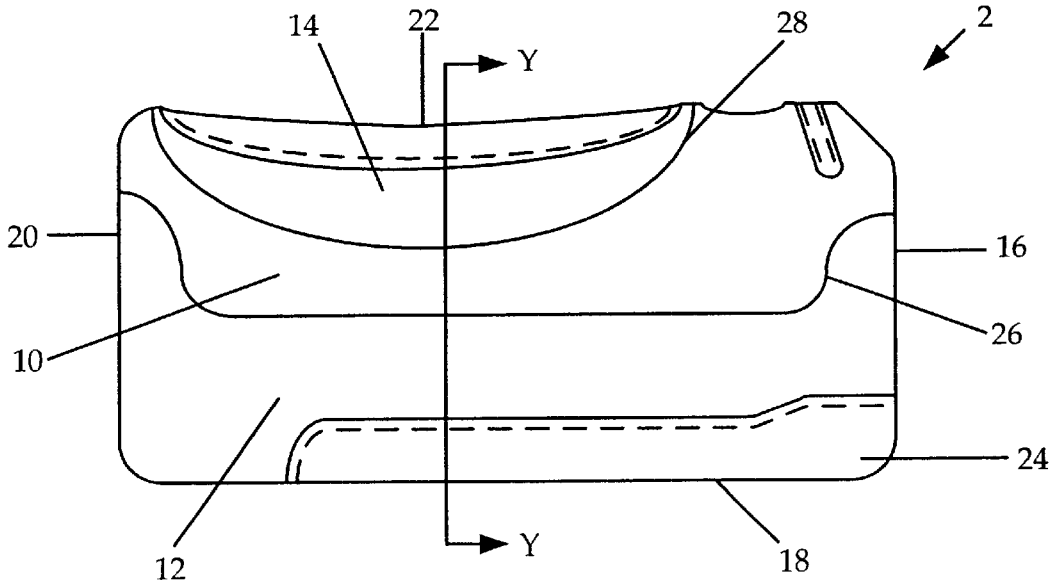
FIG. 3 is a side view of an alternate embodiment of the present invention.

FIG. 3 is an alternative embodiment of the present invention. It illustrates the saddle pad (2) having a differently shaped bar cutout area (10). In this figure, a pad second standard area (14) is incorporated near the pad top edge (22) along with the pad standard area (12) which extends up from the pad bottom edge (18). Each of the pad standard area (12) and the pad second standard area (14) are thicker than the bar cutout area (10) of the saddle pad (2). The bar cutout area extends from the cutout top shoulder (28) downwardly to the cutout bottom shoulder (26) and from the pad rear edge (20) to the pad front edge (16). However, again, the bar cutout area (10) shape and depth can be modified to fit the saddle (6) and saddle tree (4). Also shown in this illustration is the wear leather (24).

Figure 4:
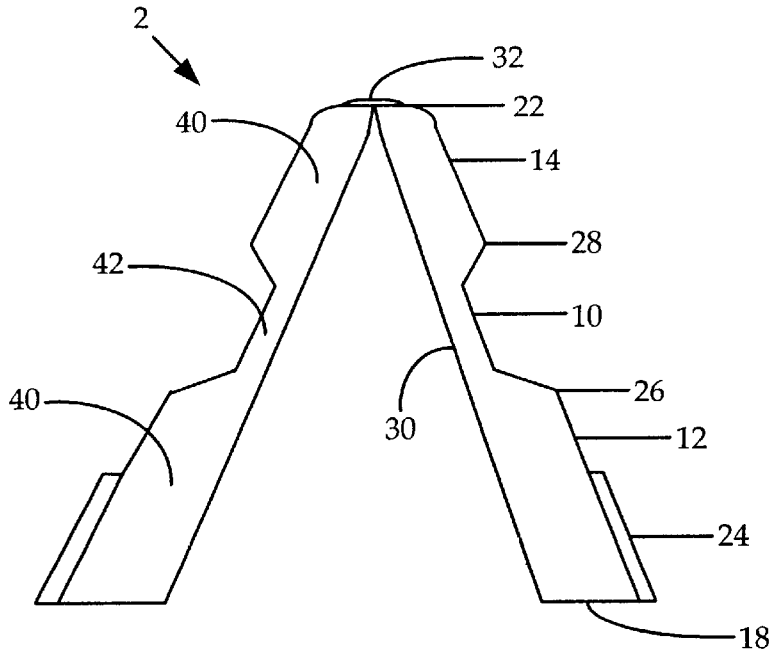
FIG. 4 is a front view of a cross-section of the present invention.

FIG. 4 illustrates a cross-sectional, front view of the second embodiment of the present invention taken along the line Y—Y of FIG. 3. It again illustrates the pad first side (34A) and pad second side (34B) flexibly connected at their pad top edges (22) by a pad middle seam (32). This figure more clearly shows the first thickness (40) of the pad second standard area (14) and the pad standard area (12), as well as the second thickness (42) of the bar cutout area (10). The pad second standard area (14) extends from the pad top edge (22) to the cutout top shoulder (28); and the pad standard area (12) extends from the cutout bottom shoulder (26) to the pad bottom edge.(18) over the pad standard area (12) is the wear leather (24). The first thickness (40) may range from ⅛ of an inch to 2⅛ of an inch thick, while the second thickness (42) may range from 1/16 of an inch thick to 2 inches thick. However, the first thickness (40) should always be at least ⅛ of an inch thicker than the second thickness (42).

Figure 5:
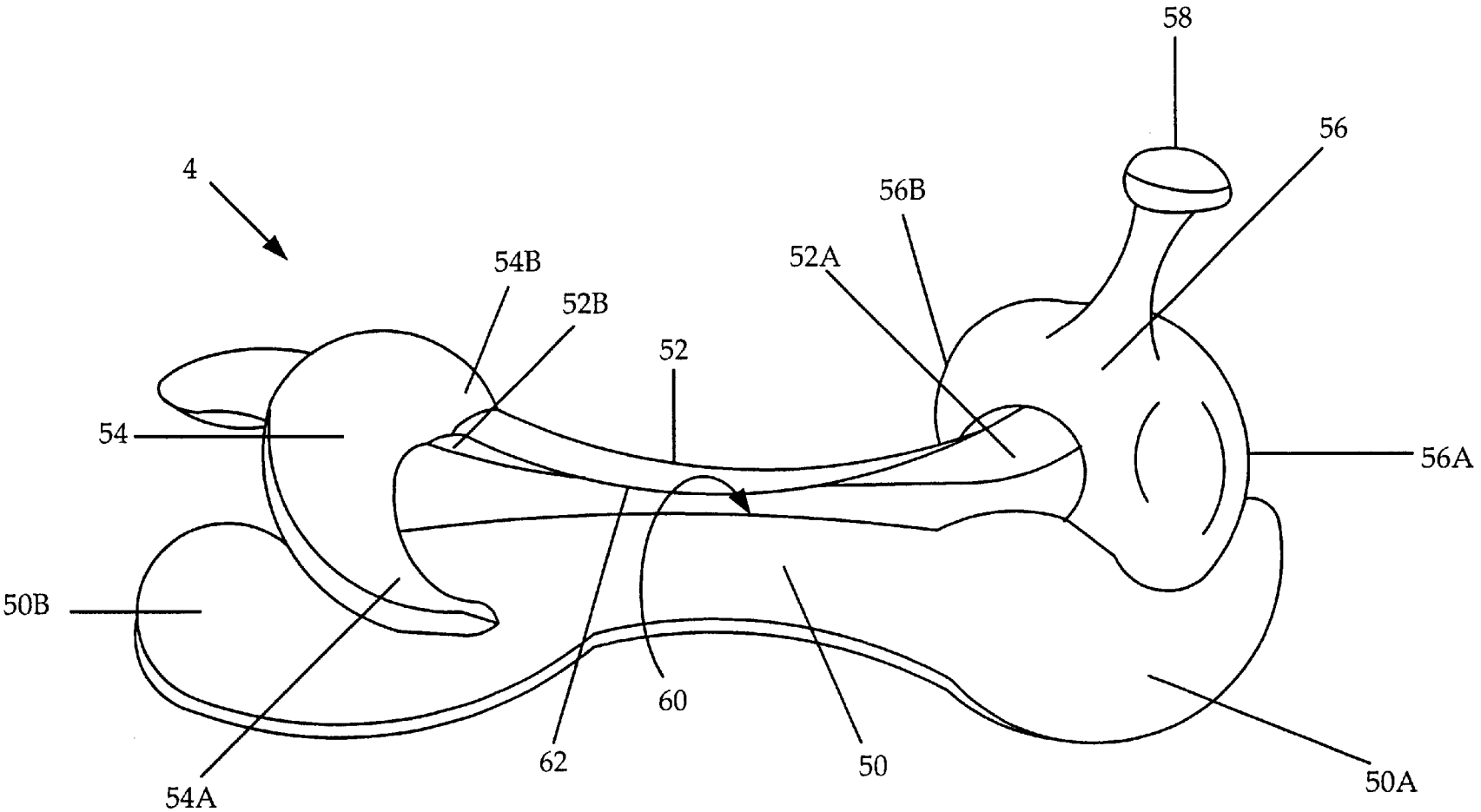
FIG. 5 is a perspective view of a saddle tree.

FIG. 5 illustrates a saddle tree (4). This figure is included in order to show the inner portion of a saddle (6) and thus to help illustrate the components of a saddle (6) that create the pressure points which the present invention helps to reduce or alleviate. The saddle tree (4) is traditionally made from rawhide covered wood; however, like many other items, many other materials such as fiberglass, nylon, and plastics are now being used to make saddle trees (4). The general structure of the tree includes an arched pommel (56) and arched cantle (54). At the top of the arch of the pommel (56) is a tree horn (58). The pommel first end (56A) is attached to a first bar first end (50A). The first bar (50) extends backward from the pommel first end (56A) where it attaches to the cantle first end (54A). Likewise, a second bar (52) is attached at its first end (52A) to the pommel second end (56B), and the second bar second end (52B) is attached to the cantle second end (54B). It is bars (50 and 52) under which pressure points generally develop. The first bar (50) has an inner surface (60), and the second bar (52) has an inner surface (62), that although covered, rests along the animal's back on either side of its spine. The rigidity of the saddle tree (4) helps maintain the shape of the saddle, as well as providing support and a solid base for the rider as well as other items that may be tied or attached to the saddle (6).

Figure 6:
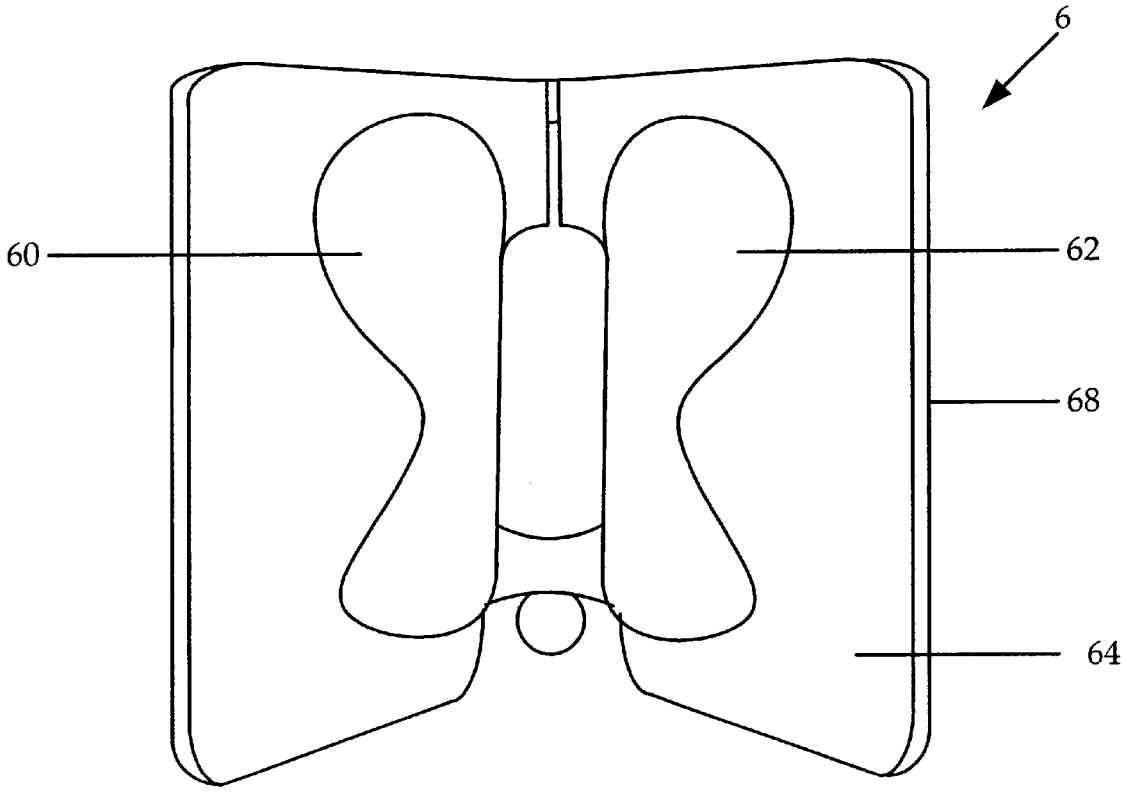
FIG. 6 is a bottom view of a saddle.

FIG. 6 illustrates the underside of a saddle (6). In this figure, the saddle (6) has been built around the saddle tree (4). In the center of the saddle (6), the arch of the pommel (56) forms the gullet (66) of the saddle. The gullet (66) is an arch that runs down the center of the saddle (6). This portion of the saddle lays over the animal's spine and from it extend the skirts (68). Shown in this figure is the skirt inner surface (64) which generally has a layer of padding such as natural or manmade fleece. Although generally covered in a finished saddle (6), the bars of the saddle tree (4) are indicated in this figure which shows the first bar inner surface (60) and the second bar inner surface (62). The saddle (6) thus fits down over the saddle pad (2) of the present invention with the portions of the skirt inner surface (64) that cover the first bar inner surface (60) and the second bar inner surface (62) resting on the bar cutout area (10) of the pad (2), further the remainder of the skirt inner surface (64) rests on the pad standard area (12) of the saddle pad (2).

Figure 7:
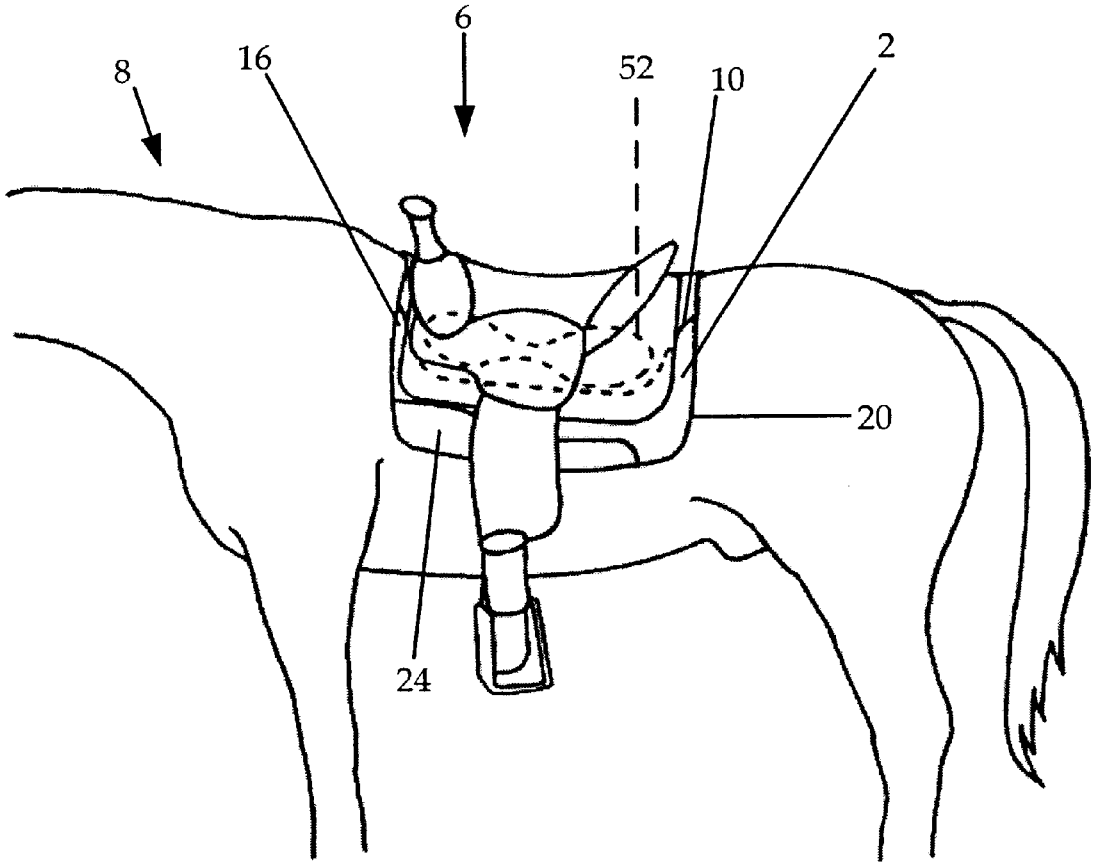
FIG. 7 illustrates the present invention in use.

FIG. 7 illustrates the saddle pad (2) in place on a horse (8) with a saddle (6). The pad front edge (16) generally extends slightly in front of the saddle (6) while the pad rear edge (20) generally extends behind the saddle (6). The girth (70) extends from either side of the saddle (6) around the horse (8) and holds the saddle (6) and saddle pad (2) tightly in place. The wear leather (24) helps protect the saddle pad (2) from wear at the point where the girth (70) connects with the saddle (6) which often causes excessive wear to the saddle pad. Indicated in FIG. 7 is the location of the second bar (52) resting on the saddle pad (2), and more specifically over the bar cutout area (10) because the remainder of the saddle pad (2) standard area (12) is below the remainder of the skirt inner surface (64), and the saddle tree (4) is allowed to sink into the bar cutout area (10), more weight is disbursed over the entirety of the skirt inner surface (64), thus disbursing the downward forces and reducing pressure-points along the first bar inner surface (60) and the second bar inner surface (62).

Although the invention has been described with reference to specific embodiments, this description is not meant to be construed in a limited sense. Various modifications of the disclosed embodiments, as well as alternative embodiments of the inventions will become apparent to-persons skilled in the art upon the reference to the description of the invention. It is, therefore, contemplated that the appended claims will cover such modifications that fall within the scope of the invention.

I claim:

1. A saddle pad for use with a saddle which has a saddle tree with bars, and the saddle pad and saddle placed on an animal, comprising:

said saddle pad having a first side and a second side, each side having a top edge and an inner surface;

said first side and said second side flexibly connected along said top edges forming a middle seam;

each of said first side and said second side having a standard area of a first thickness and a bar cut-out area of a second thickness, said first thickness being thicker than said second thickness; and said bar cut-out areas located on said first side and said second side such that when said saddle pad is placed on said animal, between said animal and said saddle with said inner surfaces oriented toward said animal and said middle seam running substantially along said animal's spine, said saddle tree bars set over said bar cut-out area.

2. The saddle pad of claim 1, wherein said bar cut-out area is sized such that it is larger than that portion of said saddle tree bar that exerts pressure upon said animal.

3. The saddle pad of claim 1, wherein said first thickness is at least 1/16" thicker than said second thickness.

4. The saddle pad of claim 3, wherein said first thickness is between ⅛" to 2⅛" thick and said second thickness is between 1/16" and 2 1/16" thick.

5. A saddle pad for use with a saddle having skirts, said saddle built over a saddle tree having bars, and the saddle pad and saddle placed on an animal, comprising:

said saddle pad sized to fit over a portion of said animals back;

said saddle pad substantially symmetrical about a middle seam;

saddle pad having a standard area with a first thickness and a bar cut-out area with a second thickness, said first thickness being thicker than said second thickness;

said saddle pad is sized such that when said saddle pad is placed upon said animal with said middle seam substantially along said animal's spine and said saddle is placed over said saddle pad on said animal, said saddle tree bars set over said bar cut-out area of said saddle pad on said animal.

6. The saddle pad of claim 5 wherein said saddle pad is sized such that when said saddle pad is placed upon said animal with said middle seam substantially along said animal's spine and said saddle is placed over said saddle pad on said animal, said saddle skirts set over said standard area of said saddle pad on said animal.

* * * * *